United States Patent [19]

Fender

[11] 4,046,050

[45] Sept. 6, 1977

[54] STRING POST FOR MUSICAL INSTRUMENTS

[76] Inventor: C. Leo Fender, 2851 Rolling Hills Drive Sp. 33, Fullerton, Calif. 92635

[21] Appl. No.: 660,640

[22] Filed: Feb. 23, 1976

[51] Int. Cl.[2] ..... G10D 3/14

[52] U.S. Cl. ..... 84/304; 84/306

[58] Field of Search ..... 84/304, 305, 306

[56] References Cited

U.S. PATENT DOCUMENTS

| | | | |
|---|---|---|---|
| 554,057 | 2/1896 | Durkee | 84/304 |
| 609,531 | 8/1898 | Brandt | 84/306 |
| 1,672,348 | 6/1928 | Sharpe | 84/304 |
| 2,029,134 | 1/1936 | Stanley et al. | 84/304 |
| 2,558,059 | 6/1951 | Nyhagen | 84/304 |

*Primary Examiner*—Stephen J. Tomsky
*Attorney, Agent, or Firm*—Philip M. Hinderstein

[57] ABSTRACT

A string post for a musical instrument of the type which extends perpendicular to the instrument head and is adapted to be rotated manually to tighten a string wrapped therearound, the string post having a constantly decreasing diameter from the outer end thereof to a plane closely adjacent the instrument head so as to urge a string wrapped therearound toward and into contact with the instrument head.

2 Claims, 7 Drawing Figures

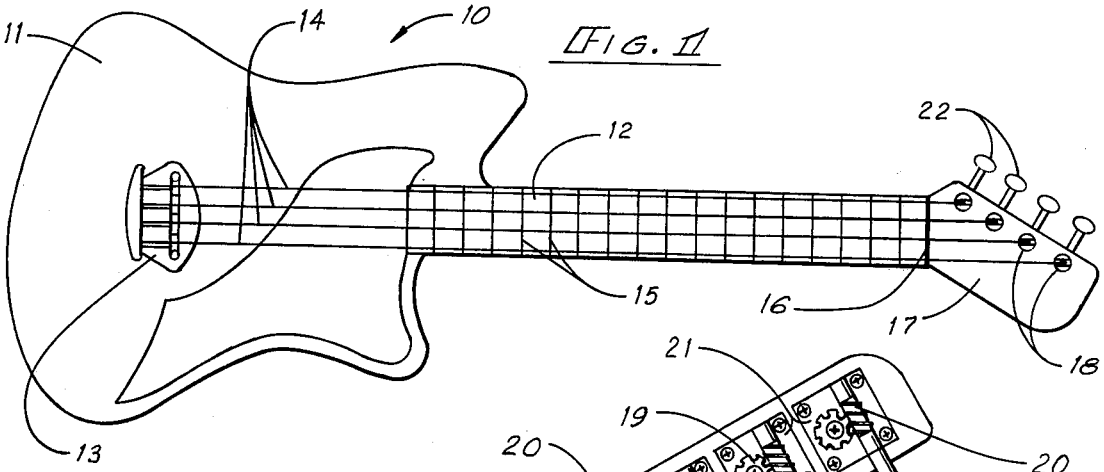
FIG. 1
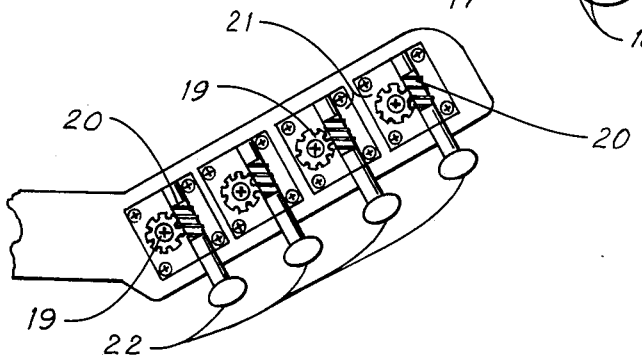
FIG. 2
FIG. 3A
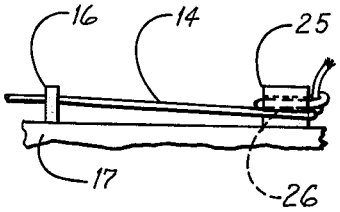
PRIOR ART
FIG. 3B
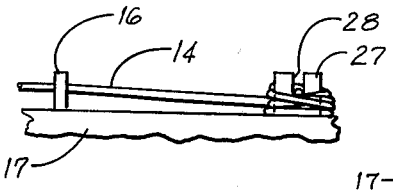
PRIOR ART
FIG. 3C
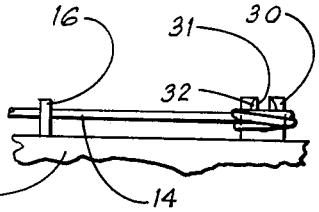
PRIOR ART
FIG. 3D
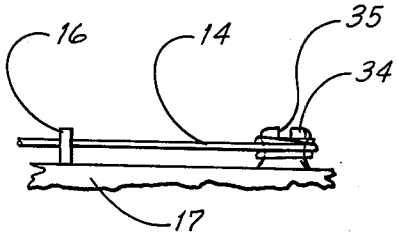
PRIOR ART
FIG. 4
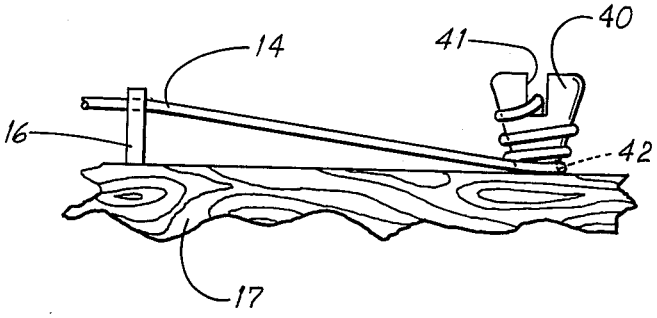

STRING POST FOR MUSICAL INSTRUMENTS

BACKGROUND OF THE INVENTION

1. Field of the Invention.

The present invention relates to a string post for a musical instrument and, more particularly, to a musical instrument string post which maximizes the string pressure on the instrument nut.

2. Description of the Prior Art.

In a conventional stringed instrument, such as a guitar, bass and the like, a plurality of strings extend from a bridge, across the instrument body, and over a neck to the head of the instrument. At the end of the neck, the strings pass through grooves in a nut positioned at the intersection of the neck and the head and are then wrapped around a plurality of string posts connected to the head. A typical string post extends perpendicular to the instrument head and is adapted to be rotated manually to tighten the string wrapped therearound. Rotation of the string post changes the pitch of the string, permitting tuning of the instrument.

In such an instrument, it is important that each string be held down firmly in its associated groove in the instrument nut. In cases where this is not done, several problems are presented. Initially, if the string is not held firmly in the groove in the nut, it can literally jump out of the groove during playing of the instrument and this would, among other things, change the pitch of the string. Secondly, since the tone sustaining capability of a string is a direct function of the rigidity of its end point connections, the ability of the string to move in the groove in the nut, the nut defining one end point connection, substantially reduces the tone sustaining capability of the string below the level which is theoretically obtainable.

In most instruments, no effort is made to increase the pressure between each string and the nut over that obtainable simply by extending the string between the instrument bridge and the string post. In some instruments, buttons or other attachments are connected to the instrument head and the strings engage such attachments between the nut and the string posts so that the strings are held close to the instrument head. While this increases the pressure between the strings and the nut, there is not always sufficient room to use such attachments and they add an additional expense to the instrument. While the string posts themselves have the capability of substantially affecting the pressure between the strings and the instrument nut, no attempts have been made heretofore to take advantage of this capability.

SUMMARY OF THE INVENTION

According to the present invention, these problems are solved by providing a novel string post for musical instruments. The present string post urges a string wrapped therearound toward the instrument head, holding the end of each string as close to the instrument head as is practically feasible. This increases the wrap of the string over the instrument nut, increasing the pressure of the string on the nut, virtually eliminating the possibility of the string moving in or out of the groove in the nut. The present string post also substantially reduces the ability of the string to vibrate relative to the nut, substantially increasing the tone sustaining capabilities of each string over that obtainable heretofore.

Briefly, the present string post has a constantly decreasing diameter from the outer end thereof to a first plane closely adjacent (virtually at) the instrument head and has an increasing diameter from the first plane to a second plane at the instrument head so as to form a curved shoulder at the base of the post between the first and second planes. This construction urges a string wrapped around such a string post toward the instrument head until the last wrap seats against the shoulder at the base of the post, virtually in contact with the instrument head.

OBJECTS

It is therefore an object of the present invention to provide a string post for musical instruments.

It is a further object of the present invention to provide a musical instrument string post which increases the tone sustaining capabilities of a string.

It is a still further object of the present invention to provide a musical instrument string post which increases the pressure between a string and the instrument nut.

It is another object of the present invention to provide a musical instrument string post which eliminates the possibility of a string moving out of its associated groove in the instrument nut.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like parts in the several figures and wherein:

BRIEF DESCRIPTION OF THE DRAWINGS

FIG. 1 is an elevation view of a conventional stringed instrument, a solid body electric bass, including a plurality of string posts;

FIG. 2 is an elevation view of the back of the head of the instrument of FIG. 1;

FIGS. 3A through 3D are side elevation views of prior art string posts; and FIG. 4 is a side elevation view of a string post constructed in accordance with the teachings of the present invention.

DESCRIPTION OF THE PREFERRED EMBODIMENT

Referring now to the drawings and, more particularly, to FIGS. 1 and 2 thereof, there is shown a conventional musical instrument, namely a solid body bass, generally designated 10, including a body 11 and a neck 12, one end of which is connected to body 11. Also connected to body 11 is a bridge 13 to which is connected first ends of a plurality of strings 14. From bridge 13, strings 14 extend across body 11 and above neck 12. Neck 12 may also include a plurality of frets 15, the pitch of each string 14 being changeable by pressing same against one of frets 15.

At the other end of neck 12 is a nut 16 which extends thereacross, perpendicular thereto, nut 16 having a plurality of grooves in the outer surface thereof, one for each string 14. Connected to the same end of neck 12 is a head 17 which supports a plurality of string posts 18. String posts 18 extend perpendicular to head 17, typically extending entirely through head 17. First ends of posts 18 are on the same side of head 17 as strings 14 and each string 14 is adapted to be connected to one of posts 18. As is known in the art, the other end of each post 18 may be connected to a worm wheel 19 which engages a worm 20 which is mounted for rotation relative to the back of head 17 by a conventional plate 21. Rotation of worm 20 is achieved by means of a knob 22 connected to one end thereof. Accordingly, rotation of worm 20 rotates string post 18, permitting the manual tightening of a string wrapped therearound.

Referring now to FIGS. 3A through 3D, there is shown the most popular types of string posts presently available. In FIG. 3A, a string post 25 is generally cylindrical, having a constant diameter from the outer end thereof to head 17, and has a hole 26 extending laterally therethrough through which the end of string 14 is extended. With this type of string post, the turning thereof causes string 14 to be wrapped therearound in a random fashion and there is no guarantee that string 14 will be held close to head 17. Furthermore, with this configuration of string post, it is possible for string 14 to slide along the surface of post 25 and disengage itself therefrom during use.

With reference to FIG. 3B, a string post 27 is shown which is generally similar to string post 25 but for a slot 28 extending laterally therethrough, from the outer end thereof, instead of hole 26. As is shown in FIG. 3B, this configuration causes the wrapping of a string 14 therearound in a random fashion, creating the same problems which exist with string post 25.

With reference to FIG. 3C, a string post 30 is shown which is generally similar to string post 27 in that a slot 31 extends laterally therethrough, from the outer end thereof. On the other hand, the opposite ends of slot 31 have a countersink, as shown at 32, so as to form a slight curvature in the outer surface of post 30. This curvature has the tendency of centering a string 14 in the area of countersink 32, preventing string 14 from slipping off of the end of post 30. On the other hand, such countersink also holds the end of string 14 spaced by a substantial distance from head 17, thereby minimizing the pressure between string 14 and nut 16.

The string post 34 of FIG. 3D is a further extension of the concept of string post 30. That is, string post 34 has a slot 35 extending laterally therethrough, from the outer end thereof, but the diameter of the outer surface of post 34 is no longer constant. Rather, the outer diameter of string post 34 is a minimum half way between the outer end thereof and head 17 and the diameter increases in both directions from this minimum diameter plane. Such a configuration causes the end of string 14 to stay adjacent the midpoint of post 34 to prevent string 14 from slipping off of the end thereof. On the other hand, the same problem exists as with post 30 in that string 14 is held in spaced relationship relative to head 17.

Referring now to FIG. 4, there is shown a string post, generally designated 40, constructed in accordance with the teachings of the present invention. String post 40 is of the type which extends perpendicular to head 17 of instrument 10 and is adapted to be rotated manually to tighten a string 14 wrapped therearound. String post 40 also has a slot 41 extending laterally thereacross, from the outer end thereof, for receipt of string 14. String post 40 is distinguishable from string posts 25, 27, 30, and 34 in that it has a constantly decreasing diameter from the outer end thereof to a plane which is positioned closely adjacent (virtually at) instrument head 17. Preferably, the outer diameter of post 40 decreases linearly from the outer end thereof to such plane. Between such plane and the surface of head 17, the diameter of post 40 increases slightly so as to form a curved shoulder, at 42, at the base of post 40, for receipt of the lowermost wrap of string 14. At the lower end of shoulder 42, at the surface of head 17, the diameter of post 40 remains constant as it extends into and through head 17.

With such a design, a string 14 wrapped around post 40 is urged toward and virtually or actually into contact with instrument head 17. In fact, as the tension in string 14 is increased by rotating post 40, the increased tension causes string 14 to seek the plane of minimum diameter, which is at shoulder 42. Therefore, after the end of string 14 is extended into slot 41 and post 40 rotated, it is necessarily true that string 14 will extend downwardly towards head 17, rather than wrapping in a random manner, with the lowermost turn against shoulder 42.

By so positioning the end of string 14, the wrap of string 14 over nut 16 is maximized, maximizing the pressure between string 14 and nut 16. This insures that string 14 will neither move nor vibrate relative to nut 16. This not only insures that string 14 will not move out of its associated groove in nut 16, but maximizes the tone sustaining capabilities of the strings.

While the invention has been described with respect to the preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. A musical instrument comprising:

a neck;

a plurality of strings extending longitudinally across said neck;

a nut extending laterally across one end of said neck, perpendicular thereto, said nut having a plurality of grooves in the outer surface thereof, one for each of said strings;

a head connected to said one end of said neck; and a plurality of string posts extending through said head, perpendicular thereto, each of said string posts having a slot extending laterally thereacross, from the outer end thereof, for receipt of first ends of said strings, said strings being adapted to be wrapped around said string posts and said posts being rotatable to tighten the strings connected thereto, said string posts having a constantly decreasing diameter from said outer ends thereof to a first plane which is positioned virtually at said instrument head and a constantly increasing diameter from said first plane to a second plane which is coplanar with said instrument head so as to form a curved concave shoulder at the base of said posts whereby as said string posts are rotated to tighten said strings, the lowermost wrap of each string is urged toward and into said shoulder at the base of said posts and into contact with said instrument head to maximize the pressure between said strings and said instrument nut.

2. In a musical instrument of the type including a neck, a body connected to one end of said neck, a head connected to the other end of said neck, a plurality of strings extending across said neck, from said body to said head, and a plurality of string posts extending through said head, perpendicular thereto, each of said string posts having a slot extending laterally thereacross, from the outer end thereof, for receipt of first ends of said strings, said strings being adapted to be wrapped around said string posts and said string posts being rotatable to tighten the strings connected thereto, the improvement wherein:

each of said string posts has a constantly decreasing diameter from said outer end thereof to a first plane which is positioned virtually at said instrument head and a constantly increasing diameter from said first plane to a second plane which is coplanar with said instrument head so as to form a curved concave shoulder at the base of said post whereby as said string posts are rotated to tighten said strings, the lowermost wrap of each string is urged toward and into said shoulder at the base of said posts and into contact with said instrument head.

* * * * *